United States Patent [19]

Miyamoto

[11] 4,288,518

[45] Sep. 8, 1981

[54] ELECTROGRAPHIC MAGNETIC DEVELOPING METHOD

[75] Inventor: Osamu Miyamoto, Toyokawa, Japan

[73] Assignee: Minolta Camera Kabushiki Kaisha, Japan

[21] Appl. No.: 97,547

[22] Filed: Nov. 26, 1979

[30] Foreign Application Priority Data

Dec. 13, 1978 [JP] Japan ..... 53-154836
Dec. 19, 1978 [JP] Japan ..... 53-158020

[51] Int. Cl.[3] ..... G03G 13/09

[52] U.S. Cl. ..... 430/122; 430/107; 430/110

[58] Field of Search ..... 118/689, 655, 657, 658; 430/120, 121, 122, 107, 109, 110

[56] References Cited

U.S. PATENT DOCUMENTS 3,376,853 4/1968 Weiler et al. ..... 118/689
3,453,045 7/1969 Fantuzzo ..... 118/689 X
3,863,602 2/1975 Mueller et al. ..... 118/655
3,910,459 10/1975 Bock et al. ..... 118/655 X
3,961,951 6/1976 Mayer et al. ..... 430/121 X
4,070,186 1/1978 Gibson et al. ..... 430/120

FOREIGN PATENT DOCUMENTS 53-40451 10/1979 Japan ..... 430/122

*Primary Examiner*—Richard L. Schilling
*Assistant Examiner*—John L. Goodrow
*Attorney, Agent, or Firm*—Wenderoth, Lind & Ponack

[57] ABSTRACT

A method of developing latent electrostatic images comprising the steps of stirring a developer containing toner particles and carrier granules to triboelectrically charge the toner particles to a polarity suitable for developing a latent electrostatic image on an image bearing surface, causing the latent electrostatic image on the surface to electrostatically attract toner particles in the stirred developer to convert the latent image to a visible image and replenishing the developer used for the development and containing a reduced quantity of toner particles with toner particles different in triboelectric chargeability (capability of being triboelectrically charged by frictional contact with carrier granules) from the toner particles initially contained in the developer before the development.

5 Claims, 2 Drawing Figures

ELECTROGRAPHIC MAGNETIC DEVELOPING METHOD

BACKGROUND OF THE INVENTION

The present invention relates to a method of developing latent electrostatic images, and more particularly to a latent electrostatic image developing method in which a latent electrostatic image on an image bearing surface is converted to a visible image with a developer containing toner particles and carrier granules, namely with a so-called two-component developer.

Magnetic brush developing devices or cascade developing devices are known as devices for practicing such a latent electrostatic image developing method. With use of these developing devices, the developing method has actually been performed and has found wide application in the field of electrographic copying machines. The latent electrostatic developing method, as performed by the above-mentioned devices, comprises the following steps (1) to (3):

(1) The developer is forcibly stirred as by a rotating roller (generally having a spiral blade on its periphery) to triboelectrically charge the toner particles in the developer to a polarity suitable for development (usually to a polarity opposite to the polarity of latent electrostatic images).

(2) The stirred developer is fed, by magnetic conveying means, bucket conveyor or like means, to the developing station, where toner particles in the developer are electrostatically attracted to a latent electrostatic image on an image bearing surface. The latent image is converted to a visible image by the electrostatic attraction of the toner particles to the latent image.

(3) The developer used for the development and containing a reduced quantity of toner particles is collected in the developing device. The developer is replenished with fresh toner particles by toner supply means.

The latent electrostatic image developing method described above has various advantages and therefore has found wide use as already stated, whereas the method still involves problems in the durability of the developer, in other words, with respect to variations in the properties of the carrier granules. It is desired to overcome these problems.

These problems will be described below.

With repeated development of latent electrostatic images by the above method, toner particles initially contained in the developer are incessantly replaced by fresh toner particles, while the carrier granules initially contained in the developer are repeatedly used. If the development of latent images is repeated over a prolonged period of time, a substance, so-called spent toner, progressively thermally adheres to the surfaces of the carrier granules, consequently varying the inherent properties of the carrier granules per se. I have confirmed that, of the variations of the properties, the variation of the triboelectrifying ability of the carrier granules (the ability of the carrier granules to triboelectrically charge the toner particles by frictional contact therewith) immediately adversely affects the development of the latent electrostatic image and leads to the following objections.

(a) When a certain type of developer is used for the developing method, the quantity of the toner particles electrostatically attracted to the latent image gradually increases with the repetition of development, also markedly fogging the nonimage areas (the background of the latent image). Additionally toner particles are deposited on the image bearing surface in the form of a trail rearward from the latent image with respect to the movement of the surface relative to the developing device. (For convenience sake, the deposition of the toner particles will hereinafter be referred to briefly as "trailing.") My research appears to indicate that these objections are attributable to a reduction in the triboelectrifying ability of the carrier granules and to the resulting decrease in the amount of triboelectric charges on the toner particles.

(b) When another type of developer is used for the developing method, the quantity of the toner particles electrostatically attracted to the latent image gradually decreases with the repetition of development and that markedly in the solid center portions of the latent image. My analysis appears to reveal that this is attributable to an increase in the triboelectrifying ability of the carrier granules and to the resulting increase in the amount of triboelectric charges on the toner particles.

To solve these problems, it has recently been proposed to form a hard coating as of Teflon over the surfaces of the carrier granules, but the proposal involves limitations on the kind of resin usable for preparing the toner particles and another problem that the coated carrier granules have a relatively low triboelectrifying ability. The proposed remedy therefore still remains to be fully improved.

It has also been proposed to replenish the developer used for development with toner particles of larger size than the toner particles contained in the developer before it is used for development. However the use of toner particles up to 8 μm in mean size generally causes fogging to the nonimage area, whereas toner particles larger than 15 μm in mean size, if used, usually produce a rough toner image, so that it is presently impossible to use toner particles of widely varying sizes. Thus the second proposed method similarly involves problems and still remains to be fully improved before actual use. Although the method has proved satisfactory for application to developers of the type referred to in paragraph (b) above, the method fails to achieve any good result with use of developers of the type (a). And what is worse, it has been found that the method, if practiced with a developer of the type (a), aggravates the aforementioned adverse effects on development.

Accordingly the developer used for the developing method and containing contaminated carrier granules must invariably be discarded for replacement by a fresh developer after the developer has been repeatedly used for developing latent electrostatic images over a prolonged period of time (to be more specific, after making 10,000 to 20,000 copies, calculated as A4 size, with an electrophotographic copying machine presently commercially available and incorporating a magnetic brush development unit), in other words, about the time when the contamination of the carrier granules in the developer is likely to produce a serious adverse effect on development. Such developer disposal and replacement is very cumbersome and uneconomical.

SUMMARY OF THE INVENTION

The main object of the present invention is to provide a novel and very useful method of developing latent electrostatic images.

Another object of the invention is to provide a method of developing latent electrostatic images in which the developer is usable with a reduced necessity for replacement and disposal.

Another object of the invention is to provide a method of the type described above and suited to electrophotographic copying machines for developing latent electrostatic images.

These and other objects of the invention can be fulfilled by replenishing a developer used for development and containing a reduced quantity of toner particles with toner particles different in triboelectric chargeability from the toner particles contained in the developer before it is used for the development.

Stated more specifically the present invention involves a method of repetitively developing latent electrostatic images comprising:

a first step of stirring a developer containing toner particles and carrier granules to triboelectrically charge the toner particles to a polarity suitable for developing a latent electrostatic image on an image bearing surface, a second step of causing the latent electrostatic image on the surface to electrostatically attract toner particles in the stirred developer to convert the latent image to a visible image and a third step of determining whether there is an increase or decrease in the degree of attraction of the toner particles to the latent image as the developing method is repeated and if there is an increase in the degree of attraction, then replenishing the developer used for development which contains a reduced quantity of toner particles, with toner particles having higher triboelectric chargeability than the toner particles contained in the toner before development and if there is a decrease in the degree of attraction, then replenishing the developer used for development which contains a reduced quantity of toner particles, with toner particles having lower triboelectric chargeability than the toner particles contained in the toner before development, the size of said toner particles supplied in said third step being approximately equal in size to the toner particles initially contained in the developer;

whereby the degree of attraction of the toner particles to the latent image upon repeated development becomes more uniform.

Stated still more specifically, the carrier granules have magnetic properties, and the second step is performed by causing a developer bearing member to attract the developer in the form of a magnetic brush and bringing the magnetic brush of the developer into frictional contact with the latent electrostatic image bearing surface.

The toner particles to be supplied in the third step are higher in triboelectric chargeability than the toner particles contained in the developer before the developer is used for the development.

The toner particles to be supplied in the third step are approximately equal in size to the toner particles initially contained in the developer before the development.

Useful replenishing toner particles include those different from the toner particles initially contained in the developer before the development, in the proportion of charge controlling agent incorporated therein.

Useful replenishing toner particles also include those different in composition from the toner particles initially contained in the developer before the development.

Further useful toner particles for the third step are identical in composition with the toner particles initially contained in the developer before the development but differ therefrom in the period of time during which the composition is kneaded with heating for the preparation of the toner particles.

The third step may be such that the developer used for the development is first replenished with the same toner particles as initially contained in the developer before the development while the developer is replenished with toner particles of different triboelectric chargeability after having been repeatedly used to some extent for developing latent electrostatic images.

These and other objects, advantages and features of the invention will become apparent from the following description thereof when read in conjunction with the accompanying drawings which illustrate exemplary embodiments of the invention.

DETAILED DESCRIPTION OF THE INVENTION

Figure 1:
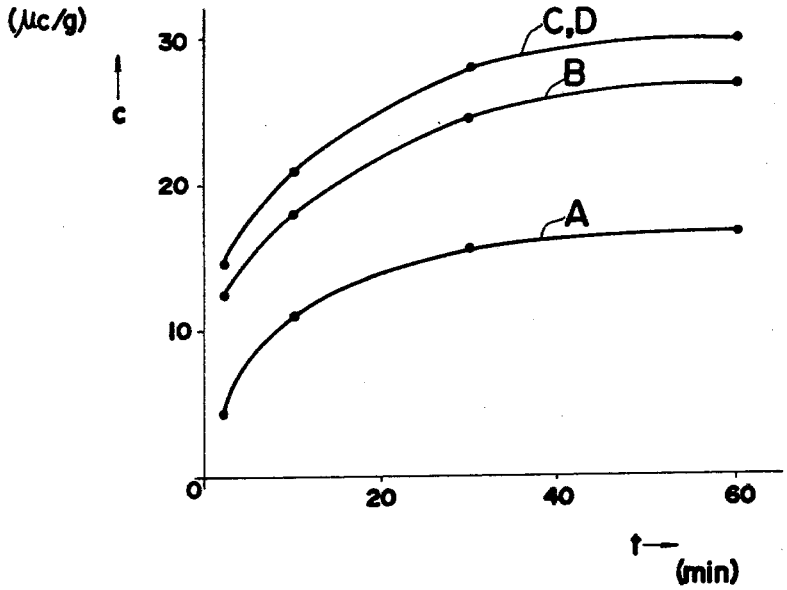
FIG. 1 is a graph showing the properties of toner particles useful for the latent electrostatic image developing method of the invention, in which the amount of triboelectric charges on the toner particles is plotted as ordinate vs. the time during which the toner particles and carrier granules are stirred in mixture and which is plotted as abscissa.

The toner particles and the carrier granules constituting the developers useful for the method of this invention for developing latent electrostatic images and also the toner particles for replenishing the developer include those heretofore known and suitably selected. Especially the replenishing toner particles must be selected with full consideration given to the amount of triboelectric charges to be generated thereon when the toner particles are mixed and stirred with the carrier granules already contaminated or to be contaminated.

Toners different in triboelectric chargeability are prepared from materials arranged in different positions in a triboelectric series or by different production conditions, for example, by heat-kneading the composition to be made into the toner particles for different periods of time for different toners. However the replenishing toner particles should not be such that the replenishment will alter the developing characteristics of the developer before the replenishment. Thus the replenishment should not be such that the developed image will be of degraded quality or have reduced amenability to fixing.

The developer used for development may be replenished soley with toner particles different in triboelectric chargeability from the toner particles initially contained in the developer before the development, or may be replenished first with the same toner particles as initially contained in the developer and then with such toner particles of different chargeability after the developer has been repeatedly used to some extent for developing latent electrostatic images.

The method of this invention for developing latent electrostatic images will be described below with reference to experimental examples, in which for convenience sake, developers of the type mentioned in the above paragraph (a) were used. The method as practiced with use of developers of the type (b) will not be described, because one skilled in the art will readily understand from the following description that developers (b) are usable for the same method when replenished with toner particles of reduced triboelectric chargeability.

EXPERIMENTAL EXAMPLE I

Carrier granules:

Iron granules subjected to oxidation and 150 μm in mean size.

Toner particles A:

Particles 12 μm in mean size and prepared from 95 parts by weight of a styrene resin (styrene-acrylic ester copolymer), 4 parts by weight of carbon black and 1 part by weight of a charge controlling agent (electron acccepting organic dye) by kneading the ingredients with heating, followed by cooling, then pulverizing and screening.

Toner particles B:

Particles 12 μm is mean size and prepared in exactly the same manner as the toner particles A except that the ingredients were heat-kneaded for several times as long a period of time.

Toner particles C:

Particles 12 μm in mean size and prepared in exactly the same manner as the toner particles A except that 94 parts by weight of the styrene resin and 2 parts by weight of the charge controlling agent were used.

The above carrier granules and toner particles A, B and C were prepared. The toner particles A were admixed with a quantity of the carrier granules, and the mixture was stirred for varying periods of time to check the toner particles A for triboelectric chargeability by the carrier granules. The result is indicated by a curve A in FIG. 1, in which the amount triboelectric charge (μc/g) of the toner particles as measured by the blow-off method was plotted as ordinate vs. the stirring time as abscissa. The same procedure as above was repeated for the toner particles B and C, with the results represented by curves B and C respectively. The content of the toner particles in each of the mixtures was 5% by weight.

FIG. 1 reveals that the triboelectric chargeability of the toner particles by the same type of carrier granules alters with the variation of composition of the toner as well as of the production condition therefor. It is also seen that the triboelectric chargeability increases in the order of the toner particles A, B and C.

EXPERIMENTAL EXAMPLE II

Figure 2:
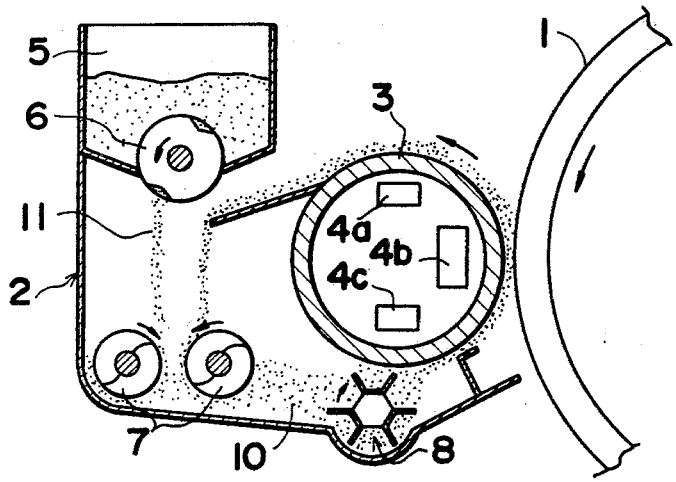
FIG. 2 is a diagram showing a magnetic brush developing unit useful for practicing the developing method of the invention, the developing unit being illustrated as incorporated in an electrophotographic copying machine of the toner image transfer type.

The following developing experiment was conducted with use of the magnetic brush developing unit shown in FIG. 2.

The magnetic brush developing unit 2 is illustrated in FIG. 2 as incorporated in an electrophotographic copying machine of the power image transfer type. The developing unit 2 is provided for a photoconductive drum 1 for bearing on its surface the latent electrostatic image to be formed by a charger and an exposure unit. The developing unit 2 includes a rotatable developing sleeve 3 opposed to the photoconductive drum 1, a magnetic brush forming assembly housed in the sleeve 3 and comprising magnets 4*a*, 4*b* and 4*c*, a roller 6 for replenishing a developer 10 with toner particles in a hopper 5, stirring rollers 7 and 7 and a feed roller 8.

The developer 10 is charged by being stirred with the rotatable stirring rollers 7 and 7, applied to the developing sleeve 3 by the feed roller 8 and brought into rubbing contact with the surface of the photoconductive drum 1 by the rotation of the developing sleeve 3 while being retained on the sleeve 3 by the magnets 4*a*, 4*b* and 4*c* to develop the latent electrostatic image on the drum surface. After development, the developer is returned to the stirring rollers 7 and 7, by which it is stirred with a fresh supply of toner particles 11.

The photoconductive drum 1, charged to +600 V by the charger (not shown), is exposed to the projected image of a test chart, whereby a latent electrostatic image is formed on the drum surface. Bias voltage of +200 V is applied to the developing sleeve 3. The drum 1 and the sleeve 3 are driven at circumferential speeds of 220 mm/sec and 330 mm/sec respectively. The replenishing roller 6 is controlled to maintain the toner concentration (toner content of the developer) at 5% by weight. The toner particles in the developer 10 are triboelectrically charged to a negative polarity by being stirred with the stirring rollers 7 and 7.

The latent electrostatic image was repeatedly and continually developed by the unit to check the amount of triboelectric charges on the toner particles contained in the developer and the state of the developed image. Table 1 shows the results.

The experiment was conducted for three cases with use of replenishing toner particles: one solely with use of toner particles A prepared in Experimental Example I, another case in which the latent image on the surface of the drum 1 was developed with use of toner particles A for 13,000 copies of A4 size, with the replenishing toner particles thereafter replaced by toner particles B, and another case in which toner particles A were similarly used first and subsequently replaced by toner particles C. The developer for starting the experiment (containing the same carrier granules and toner particles A as used in Experimental Example I) was thoroughly stirred for 120 minutes by a stirrer and thereby charged to the desired level and thereafter placed into the developing unit 2.

TABLE 1

| | Replenishing toner particles | | |
|---|---|---|---|
| Development | A | A → B | A → C |
| For 1,000 copies | Good (20) | Good (20) | Good (20) |
| For 13,000 copies | Slight trailing (11.5) | Slight trailing (11.5) | Slight trailing (11.5) |
| For 14,000 copies | Trailing (10.5) | Good (18.5) | Good (20.3) |
| For 20,000 copies | Trailing and fogging (4) | Good (16.0) | Good (17.5) |

Listed in each column of the table is the state of the developed image as evaluated with the unaided eye, with the amount of charges (μc/g), as measured by the blow-off method, given in the parentheses.

Table 1 reveals that when the same toner particles as initially contained in the developer are continuously used for replenishment, the contamination of the carrier granules causes trailing or fogging, whereas the same carrier granules assure a steady satisfactory developing operation over a prolonged period of time if the replenishing toner particles in use are replaced by toner particles of different triboelectric chargeability.

Although the replenishing toner particles were changed only one in each case in Experimental Example II above, I have confirmed that similarly good results can be achieved when the replenishing toner particles A are replaced first with the toner particles B and then with the toner particles C.

EXPERIMENTAL EXAMPLE III

Toner particles D:

Particles 12 μm in mean size and prepared from 93 parts by weight of a styrene resin (styrene-acrylic ester copolymer), 4 parts by weight of carbon black and 3 parts by weight of a charge controlling agent (electron accepting organic dye) by kneading the ingredients with heating, followed by cooling, then pulverizing and thereafter screening.

The toner particles D prepared as above were checked for triboelectric chargeability by carrier granules in the same manner as in Experimental Example I. The result is represented by a curve D, FIG. 1 (in register with the curve C) and is substantially identical with that achieved with the toner particles C.

Subsequently the magnetic brush developing unit shown in FIG. 2 was used for the following experiment. The same carrier granules and toner particles A as used in Experimental Example I were mixed together and stirred in a stirrer for 120 minutes to prepare a developer, which was placed into the developing unit as a start-up developer. With use of toner particles D for replenishment, a latent electrostatic image was repeatedly continually developed by the developing unit to check the state of the developed image.

Consequently sharp developed images with a very satisfactory density in an outstanding state were obtained for 10,000 copies of A4 size and also for 20,000 copies of the same size. However slight trailing occurred by the time when the image was developed nearly 30,000 times.

For the evaluation of the developed image in this experiment, the toner image on the surface of the photoconductive drum 2 was checked and thereafter erased from the drum surface with an unillustrated cleaning unit.

COMPARATIVE EXPERIMENTAL EXAMPLE

In the same manner as in Experimental Example III, a developing experiment was conducted with the unit of FIG. 2 using the start-up developers and replenishing toner particles listed in Table 2. Table 3 shows the results.

TABLE 2

| Example | Start-up developer | Replenishment |
|---|---|---|
| i | Toner particles A and carrier granules stirred for 120 min | Toner particles A |
| ii | Toner particles D and carrier granules stirred for 120 min | Toner particles D |
| iii | Toner particles D and carrier granules stirred for 5 min | Toner particles D |
| iv | Toner particles D and carrier granules stirred for 1 min | Toner particles D |

TABLE 3

| Example | In initial stage of development | During prolonged development |
|---|---|---|
| i | Good | Slight trailing over 10,000 developing times, and marked trailing and fogging around 20,000 times |
| ii | Very low image density unsuited to use | Good |
| iii | Developing about 50 to 150 times resulted in reduced image density unsuited to use | Good |
| iv | Toner particles fumed in developing unit, staining neighboring parts. Fog on toner image | Good |

Tables 2 and 3 reveal that the replenishment with the same toner particles as contained in the start-up developer entails various objections as will be apparent from Examples i to iv, unlike the embodiment of the method of the invention shown in Experimental Example III. With respect to Example i, refer to Experimental Example II in which the result achieved is described in detail.

In this way latent electrostatic images can be developed very satisfactorily and steadily over a prolonged period of time by the method of this invention with a reduced necessity for the replacement and disposal of the developer that would be needed when the carrier granules are contaminated. When the developer is brought into contact with the surface of the image bearing surface in the form of a magnetic brush (for developing latent electrostatic images with use of a magnetic brush developing unit), the carrier granules become contaminated relatively earlier since the developer is subjected to a great mechanical force by stirring. In such a case, the developing method of this invention is especially effective.

Additionally the method of this invention for developing latent electrostatic images can be performed without necessitating substantial changes in the developing unit or in the process for preparing the toner particles or carrier granules and is therefore very economical.

Although the present invention has been fully described by way of example with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. In a method of repetitively developing latent electrostatic images comprising:

a first step of stirring a developer containing toner particles and carrier granules having magnetic properties to triboelectrically charge the toner particles to a polarity suitable for developing a latent electrostatic image on an image-bearing surface and a second step of causing a developer bearing member to attract the developer in the form of a magnetic brush and bringing said magnetic brush into rubbing contact with the latent electrostatic image on said image-bearing surface to electrostatically attract the toner particles thereto from said magnetic brush to convert the latent image to a visible image and wherein there is an increase or a decrease in the degree of attraction of the toner particles to the latent image as the developing method is repeated, the improvement which comprises a third step of determining whether there is an increase or decrease in the degree of attraction of the toner particles to the latent image as the developing method is repeated and if there is an increase in the degree of attraction, then replenishing the developer used for the development which contains a reduced quantity of toner particles, with toner particles having higher triboelectric chargeability than the toner particles contained in the developer before development and if there is a decrease in the degree of attraction, then replenishing the developer used for development which contains a reduced quantity of toner particles, with toner particles having lower triboelectric chargeability than the toner particles contained in the developer before development; the toner particles to be replenished and the toner particles contained in the developer being triboelectrically chargeable to the same polarity by frictional contact with the carrier granules contained in the developer; the size of said toner particles supplied in said third step being approximately equal in size to the toner particles contained in the developer, wherein said toner particles to be supplied in said third step and said toner particles initially contained in the developer before the development respectively contain a charge-controlling agent in different proportions, whereby the degree of attraction of the toner particles to the latent image upon repeated development becomes more uniform.

2. In a method of repetitively developing latent electrostatic images comprising:

a first step of stirring a developer containing toner particles and carrier granules having magnetic properties to triboelectrically charge the toner particles to a polarity suitable for developing a latent electrostatic image on an image-bearing surface and a second step of causing a developer bearing member to attract the developer in the form of a magnetic brush and bringing said magnetic brush into rubbing contact with the latent electrostatic image on said image-bearing surface to electrostatically attract the toner particles thereto from said magnetic brush to convert the latent image to a visible image and wherein there is an increase or a decrease in the degree of attraction of the toner particles to the latent image as the developing method is repeated, the improvement which comprises a third step of determining whether there is an increase or a decrease in the degree of attraction of the toner particles to the latent image as the developing method is repeated and if there is an increase in the degree of attraction, then replenishing the developer used for the development which contains a reduced quantity of toner particles, with toner particles having higher triboelectric chargeability than the toner particles contained in the developer before development and if there is a decrease in the degree of attraction, then replenishing the developer used for development which contains a reduced quantity of toner particles, with toner particles having lower triboelectric chargeability than the toner particles contained in the developer before development; the toner particles to be replenished and the toner particles contained in the developer being triboelectrically chargeable to the same polarity by frictional contact with the carrier granules contained in the developer; the size of said toner particles supplied in said third step being approximately equal in size to the toner particles contained in the developer, wherein said toner particles to be supplied in the third step are different in composition from the toner particles initially contained in the developer before the development, whereby the degree of attraction of the toner particles to the latent image upon repeated development becomes more uniform.

3. In a method of repetitively developing latent electrostatic images comprising:

a first step of stirring a developer containing toner particles and carrier granules having magnetic properties to triboelectrically charge the toner particles to a polarity suitable for developing a latent electrostatic image on an image-bearing surface and a second step of causing a developer bearing member to attract the developer in the form of a magnetic brush and bringing said magnetic brush into rubbing contact with the latent electrostatic image on said image-bearing surface to electrostatically attract the toner particles thereto from said magnetic brush to convert the latent image to a visible image and wherein there is an increase or a decrease in the degree of attraction of the toner particles to the latent image as the developing method is repeated, the improvement which comprises a third step of determining whether there is an increase or decrease in the degree of attraction of the toner particles to the latent image as the developing method is repeated and if there is an increase in the degree of attraction, then replenishing the developer used for the development which contains a reduced quantity of toner particles, with toner particles having higher triboelectric chargeability than the toner particles contained in the developer before development and if there is a decrease in the degree of attraction, then replenishing the developer used for development which contains a reduced quantity of toner particles, with toner particles having lower triboelectric chargeability than the toner particles contained in the developer before development; the toner particles to be replenished and the toner particles contained in the developer being triboelectrically chargeable to the same polarity by frictional contact with the carrier granules contained in the developer; the size of said toner particles supplied in said third step being approximately equal in size to the toner particles contained in the developer, wherein said toner particles to be supplied in the third step and said toner particles initially contained in the developer before the development are identical in composition to one another and are prepared by kneading the composition with heating, followed by cooling, then pulverizing and screening, with a difference in the period of time during which the composition is kneaded with heating, for the preparation of the toner particles, whereby the degree of attraction of the toner particles to the latent image upon repeated development becomes more uniform.

4. A method of developing latent electrostatic images as claimed in claims 1, 2 or 3 wherein said toner particles to be supplied in the third step are higher in triboelectrically chargeability than the toner particles contained in the developer before the developer is used for the development.

5. A method of developing latent electrostatic images as claimed in claims 1, 2 or 3, wherein, in said third step, the developer used for the development is first replenished with the same toner particles as initially contained in the developer before the development, and then the developer is replenished with toner particles of different triboelectric chargeability after having been repeatedly used for developing latent electrostatic images.

* * * * *